US008057075B2

(12) United States Patent
Horng et al.

(10) Patent No.: US 8,057,075 B2
(45) Date of Patent: Nov. 15, 2011

(54) LAMP DEVICE

(75) Inventors: Alex Horng, Kaohsiung (TW); I-Le Fang, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 327 days.

(21) Appl. No.: 12/403,611

(22) Filed: Mar. 13, 2009

(65) Prior Publication Data

US 2010/0232168 A1 Sep. 16, 2010

(51) Int. Cl.
*F21V 29/00* (2006.01)

(52) U.S. Cl. ..... 362/373; 362/294

(58) Field of Classification Search ..... 362/294, 362/373

See application file for complete search history.

(56) References Cited

U.S. PATENT DOCUMENTS

| | | | | |
|---|---|---|---|---|
| 6,948,829 | B2 * | 9/2005 | Verdes et al. | 362/227 |
| 7,144,135 | B2 | 12/2006 | Martin et al. | |
| 7,144,140 | B2 * | 12/2006 | Sun et al. | 362/373 |
| 7,226,189 | B2 * | 6/2007 | Lee et al. | 362/294 |
| 7,244,058 | B2 | 7/2007 | DiPenti et al. | |
| 7,524,089 | B2 * | 4/2009 | Park | 362/294 |
| 7,575,346 | B1 * | 8/2009 | Horng et al. | 362/373 |
| 7,628,513 | B2 * | 12/2009 | Chiu | 362/311.02 |
| 7,874,710 | B2 * | 1/2011 | Tsai et al. | 362/373 |

FOREIGN PATENT DOCUMENTS

| | | |
|---|---|---|
| TW | M339780 | 9/2008 |

* cited by examiner

*Primary Examiner* — Stephen F Husar
*Assistant Examiner* — James Cranson, Jr.
(74) *Attorney, Agent, or Firm* — Muncy, Geissler, Olds & Lowe, PLLC

(57) ABSTRACT

A lamp device includes a housing having first and second ends spaced in an axial direction. The housing further includes an air inlet portion and an air outlet portion. A circuit board is mounted in the housing and electrically connected to an electrical connection portion on the first end of the housing. The circuit board includes a substrate having first and second sides spaced in the axial direction and respectively facing the second and first ends of the housing. The circuit board further includes electronic elements. One of the electronic elements having the largest height in the axial direction is mounted on the first side. A heat dissipating module is mounted in the housing and between the air inlet portion and the air outlet portion. A lighting element is coupled to the heat dissipating module and electrically connected to the circuit board.

5 Claims, 6 Drawing Sheets

LAMP DEVICE

BACKGROUND OF THE INVENTION

1. Field of the Invention

The present invention relates to a lamp device and, more particularly, to a lamp device allowing smooth flow of air currents into an interior thereof for heat dissipating purposes.

2. Description of the Related Art

FIG. 1 shows a conventional lamp device 9 including a housing 91 having an outer periphery with an air inlet portion 911 and an air outlet portion 912. A lighting element 92, a heat dissipating module 93, and a circuit board 94 are mounted in the housing 91, with lighting element 92 coupled to the heat dissipating module 93 and electrically connected to the circuit board 94. When the lighting element 92 generates heat during use, the heat dissipating module 93 draws air into the housing 91 via the air inlet portion 911, and heat can be transferred out of the housing 91 via the air outlet portion 912, providing a heat dissipating effect and prolonging the life of the lamp device. The circuit board 94 includes a plurality of electronic elements 95 between the circuit board 94 and an end of the housing 91 adjacent air inlet portion 911. Due to the heights h of the electronic elements 95, the compartment between the circuit board 94 and the end of the housing 91 for receiving the electronic elements 95 is relatively large, such that the circuit board 94 interferes with the flow of air currents entering the housing 91 via the air inlet portion 911, as shown in FIG. 2. Thus, the air currents can not smoothly flow into the housing 91, leading to reduced heat dissipating effect and shortening of the life of the lighting element 92.

To reduce interference with the flow of the air currents, Taiwan Utility Model Publication No. M339780 entitled "Improved Circuit Board Structure for LED Lamp Device" discloses a circuit board including at least one aperture in an area free of electronic elements and circuits. The aperture extends from a side through the other side of the circuit board, such that the air currents entering the housing can flow smoothly into an interior of the housing via the aperture, enhancing the heat dissipating effect. However, formation of the aperture results in complicated and troublesome procedures for manufacturing the circuit board. Furthermore, the resultant heat dissipating effect is still unsatisfactory, for the circuit board still causes certain interference with the flow of the air currents entering the housing.

SUMMARY OF THE INVENTION

The primary objective of the present invention is to provide a lamp device including a circuit board that does not interfere with the flow of the air currents entering the lamp device.

A lamp device according to the preferred teachings of the present invention includes a housing having first and second ends spaced in an axial direction. The first end includes an electrical connection portion, and the second end includes a light transmitting portion. The housing further includes an air inlet portion and an air outlet portion. Each of the air inlet portion and the air outlet portion extends from an inner periphery through an outer periphery of the housing. A circuit board is mounted in the housing and electrically connected to the electrical connection portion. The circuit board includes a substrate having first and second sides spaced in the axial direction. The first side of the substrate faces the second end of the housing, and the second side of the substrate faces the first end of the housing. The circuit board further includes a plurality of electronic elements mounted on at least one of the first and second sides of the substrate. Each electronic element has a height in the axial direction. One of the electronic elements having the largest height in the axial direction is mounted on the first side and extends toward the second end of the housing. A heat dissipating module is mounted in the housing and between the air inlet portion and the air outlet portion. A lighting element is coupled to the heat dissipating module and electrically connected to the circuit board. Thus, the substrate can be in a position closer to the first end of the housing, so that the flow of air currents entering the housing via the air inlet portion will not be interfered by the substrate, providing enhanced heat dissipating effect and prolonging the life of the lamp device.

In a preferred form, the electronic elements are mounted on the first side of the substrate. In another preferred form, the electronic elements are mounted on the first and second sides of the substrate.

In a preferred form, the housing includes an inner wall having a positioning portion at the first end of the housing, and the second side of the substrate is coupled to the positioning portion. Furthermore, the positioning portion includes a plurality of pegs formed on the inner wall. A plurality of fasteners is extended through the substrate into the plurality of pegs.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
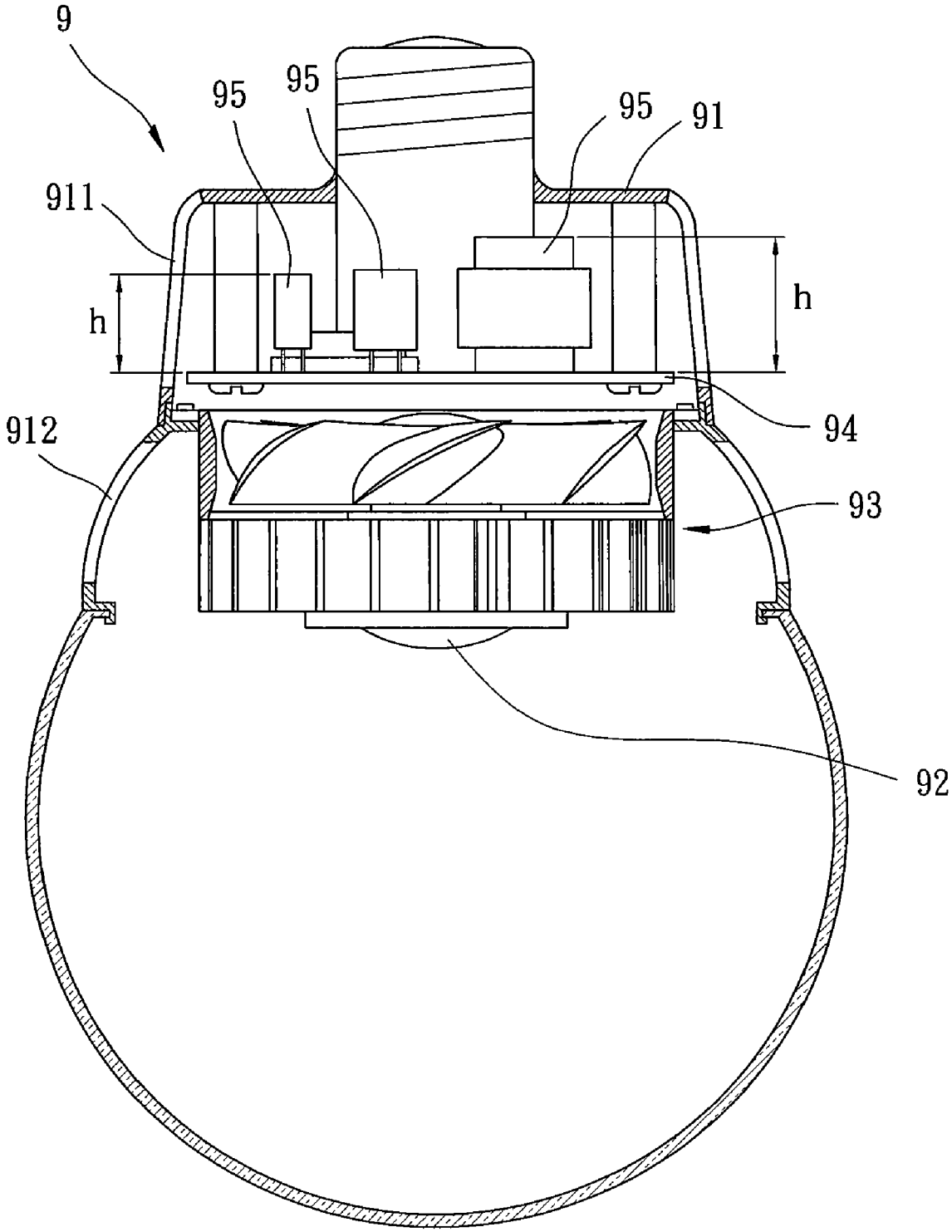
FIG. 1 PRIOR ART
FIG. 1 shows a cross sectional view of a conventional lamp device.
Figure 2:
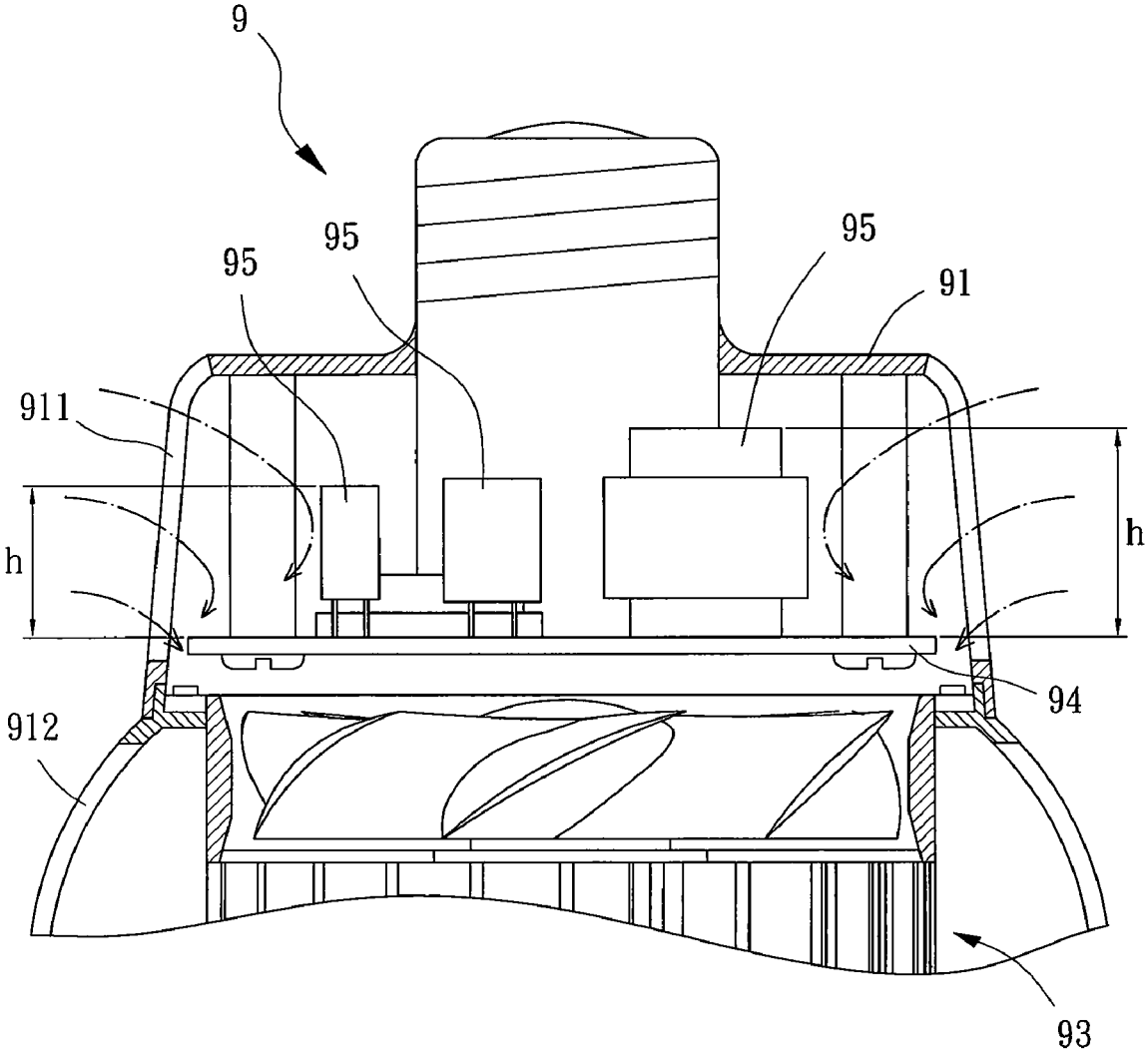
FIG. 2 PRIOR ART
FIG. 2 shows a partial, cross sectional view of the lamp device of FIG. 1, illustrating the flow of the air currents entering the lamp device for heat dissipating purposes.
Figure 3:
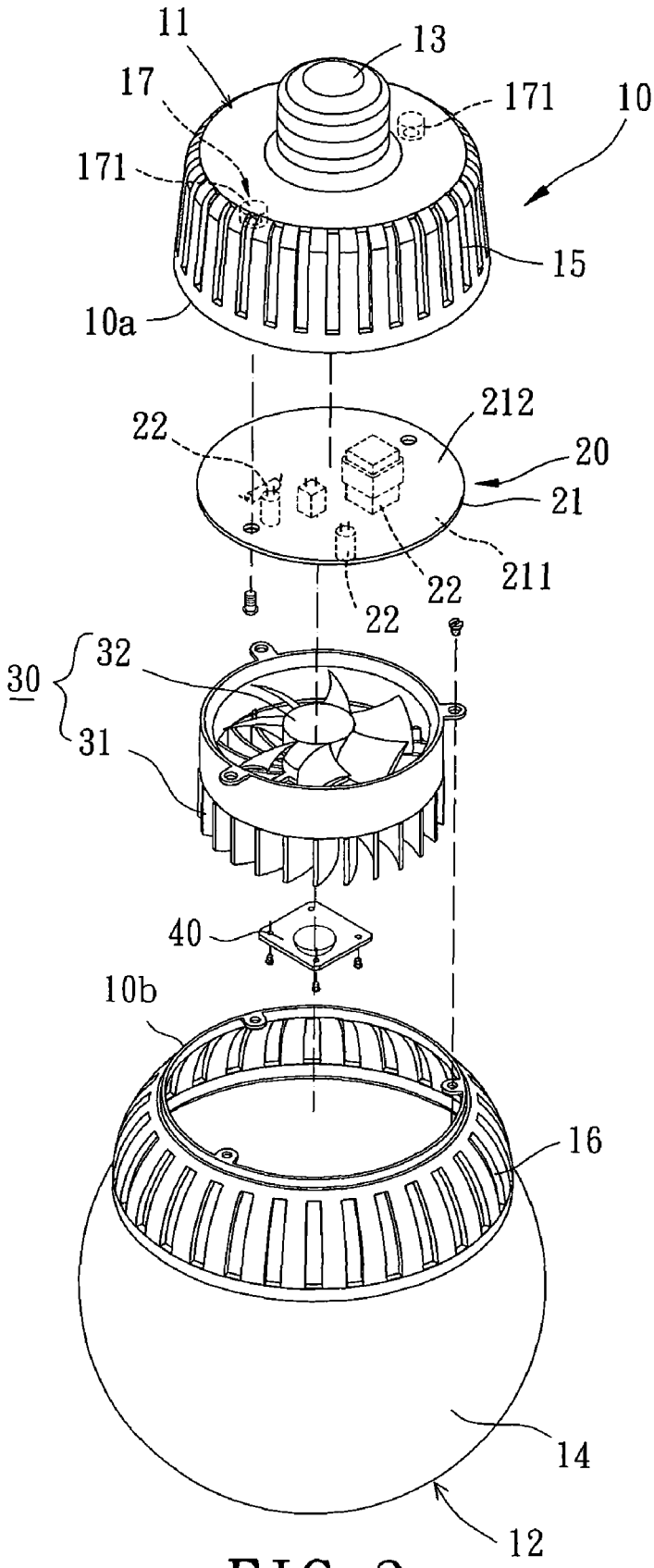
FIG. 3 shows an exploded, perspective view of a lamp device according to the preferred teachings of the present invention.
Figure 4:
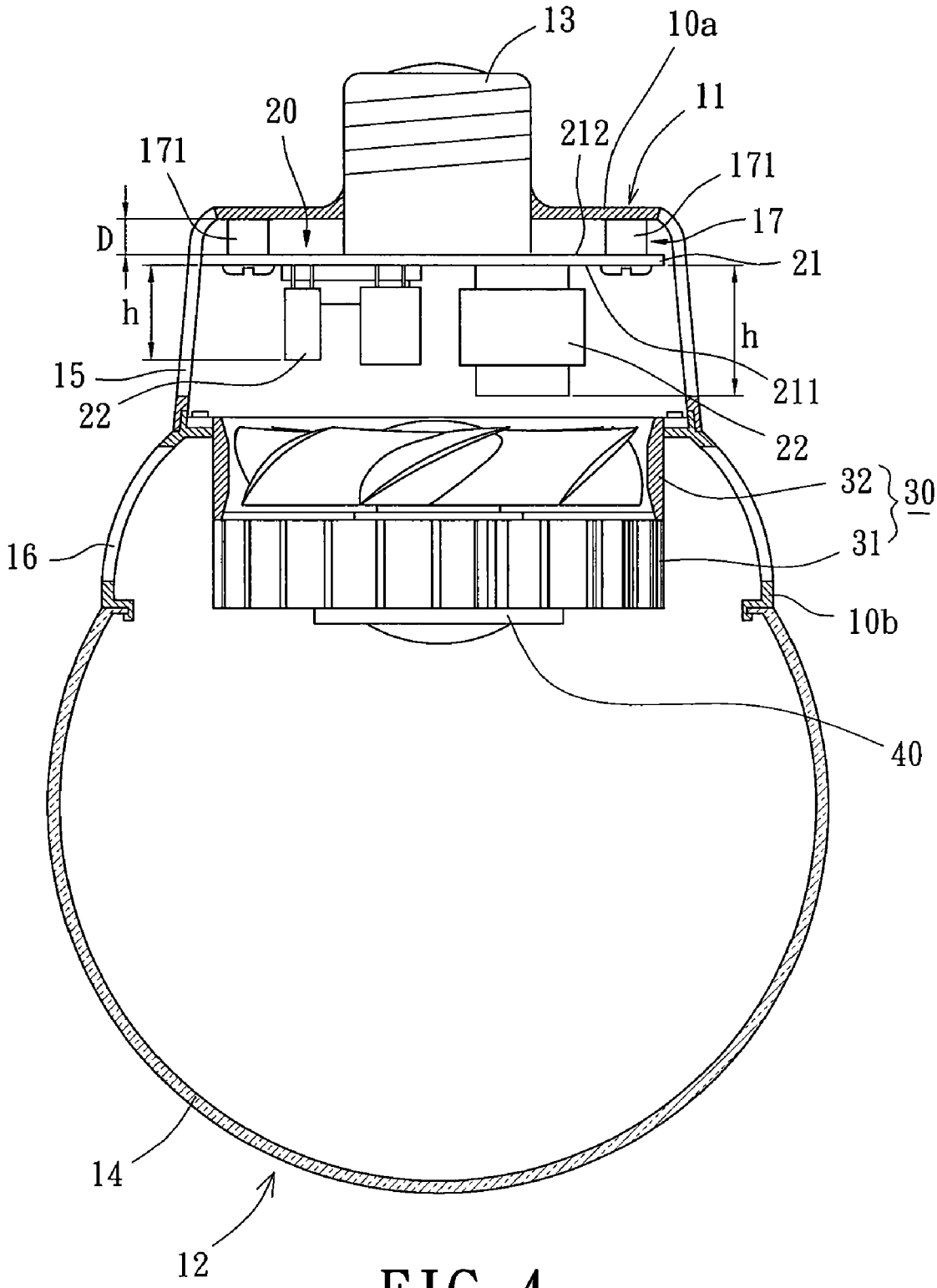
FIG. 4 shows a cross sectional view of the lamp device of FIG. 3.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "end", "portion", "axial", "spacing", "height", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A lamp device according to the preferred teachings of the present invention is shown in FIGS. 3-6 of the drawings and generally includes a housing 10, a circuit board 20, a heat dissipating module 30, and a lighting element 40. The circuit board 20, the heat dissipating module 30, and the lighting element 40 are mounted in the housing 10. The lighting element 40 is electrically connected to the circuit board 20 and emits light beams when the circuit board 20 is supplied with electricity. The heat dissipating module 30 is coupled to the lighting element 40 to provide a heat dissipating effect and to prolong the life of the lamp device.

The housing 10 can be a single housing or have two or more housing parts assembled together to provide a compartment receiving the circuit board 20, the heat dissipating module 30, and the lighting element 40. In the preferred form shown in FIGS. 3-6, the housing 10 includes two housing parts 10*a* and 10*b* assembled together by snapping, screwing, bonding, or welding.

In the preferred forms shown in FIGS. 3-6, the housing 10 includes first and second ends 11 and 12 spaced in an axial direction. The first end 11 includes an electrical connection portion 13. The second end 12 includes a light transmitting portion 14. The housing 10 further includes an air inlet portion 15 adjacent the electrical connection portion 13 and an air outlet portion 16 adjacent the light transmitting portion 14. Each of the air inlet portion 15 and the air outlet portion 16 extends from an inner periphery through an outer periphery of the housing 10 and includes a plurality of openings or slots spaced in a circumferential direction, with both of the air inlet portion 15 and air outlet portion 16 communicating with the outside and the inside of the lamp device of the present invention.

In the preferred forms shown in FIGS. 3-6, the housing 10 includes an inner wall having a positioning portion 17 in the form of a plurality of pegs 171 formed on the first end 11 and each having a screw hole. A plurality of fasteners such as screws or bolts is extended through the circuit board 20 into screw holes in each peg 171, fixing the circuit board 20 to the pegs 171. However, other forms of the positioning portion 17 would be within the skill of the art.

In the preferred forms shown in FIGS. 3-6, the circuit board 20 is electrically connected by wires to the electrical connection portion 13 of the housing 10. The circuit board 20 includes a substrate 21 having a first side 211 and a second side 212 spaced from the first side 211 in the axial direction, with the first side 211 facing the second end 12 of the housing 10 and with the second side 212 facing the first end 11 and coupled to the positioning portion 17 of the housing 10, with the substrate 21 being disposed in a position out of a region between the air inlet portion 15 and the air outlet portion 16. The circuit board 20 further includes a plurality of electronic elements 22 such as resistors, capacitors, inductors, or operational chips. The electronic elements 22 are mounted on at least one of the first and second sides 211 and 212. In the preferred form shown in FIGS. 3-4 and 6, the electronic elements 22 are mounted on the first side 211 of the substrate 21 and each have a height h in the axial direction and extend towards the second end 12 of the housing 10. Thus, when the substrate 21 is fixed to the positioning portion 17, the electronic elements 22 are not located between the first end 11 of the housing 10 and the substrate 21, shortening the spacing D between the first end 11 of the housing 10 and the substrate 21. As a result, the substrate 21 can be in a position closer to the first end 11 of the housing 10, so that the substrate 21 will not cover a large portion of the air inlet portion 15 of the housing 10.

Figure 5:
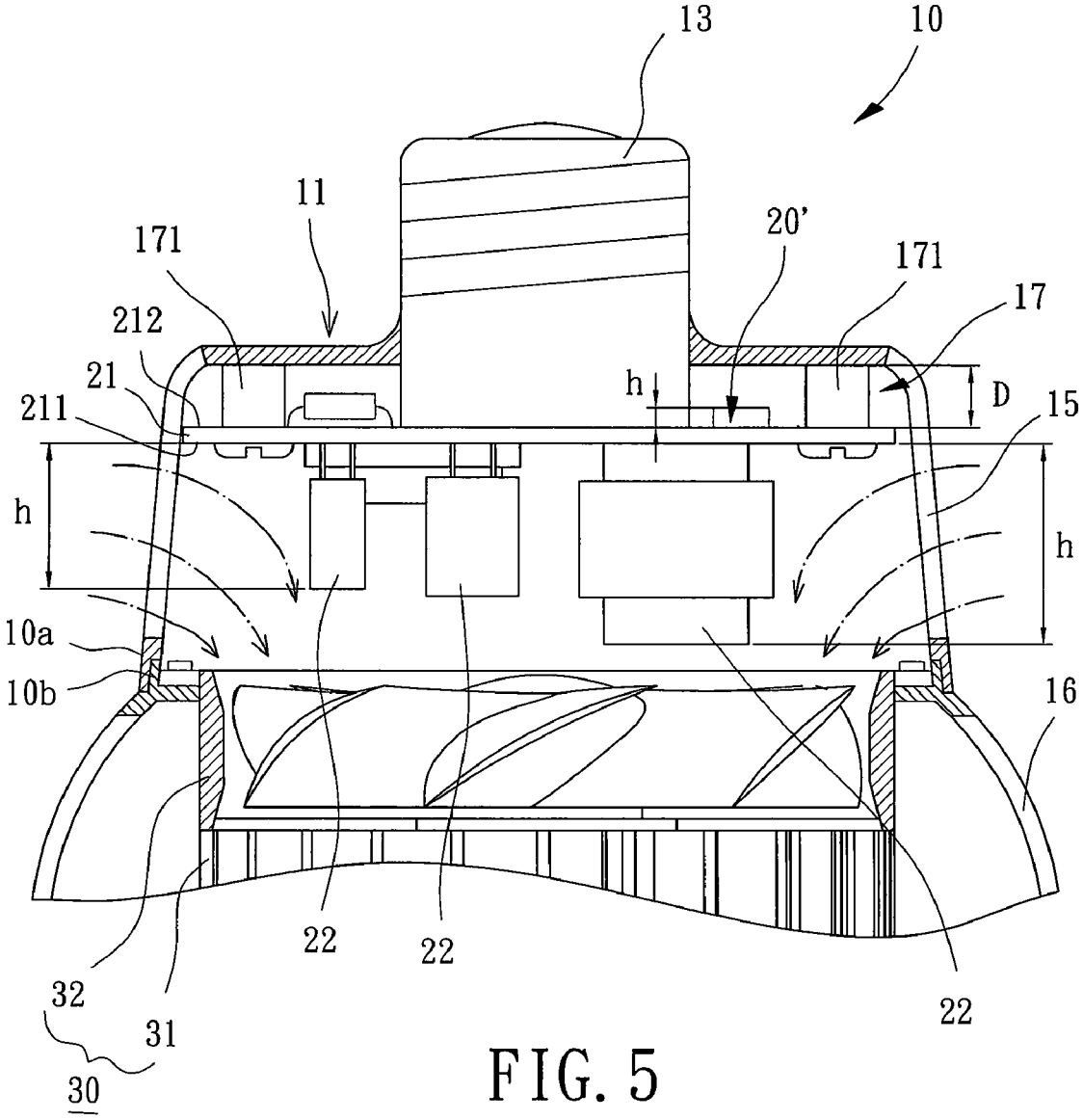
FIG. 5 shows a partial, cross sectional view of a lamp device of a modified embodiment according to the preferred teachings of the present invention.
Figure 6:
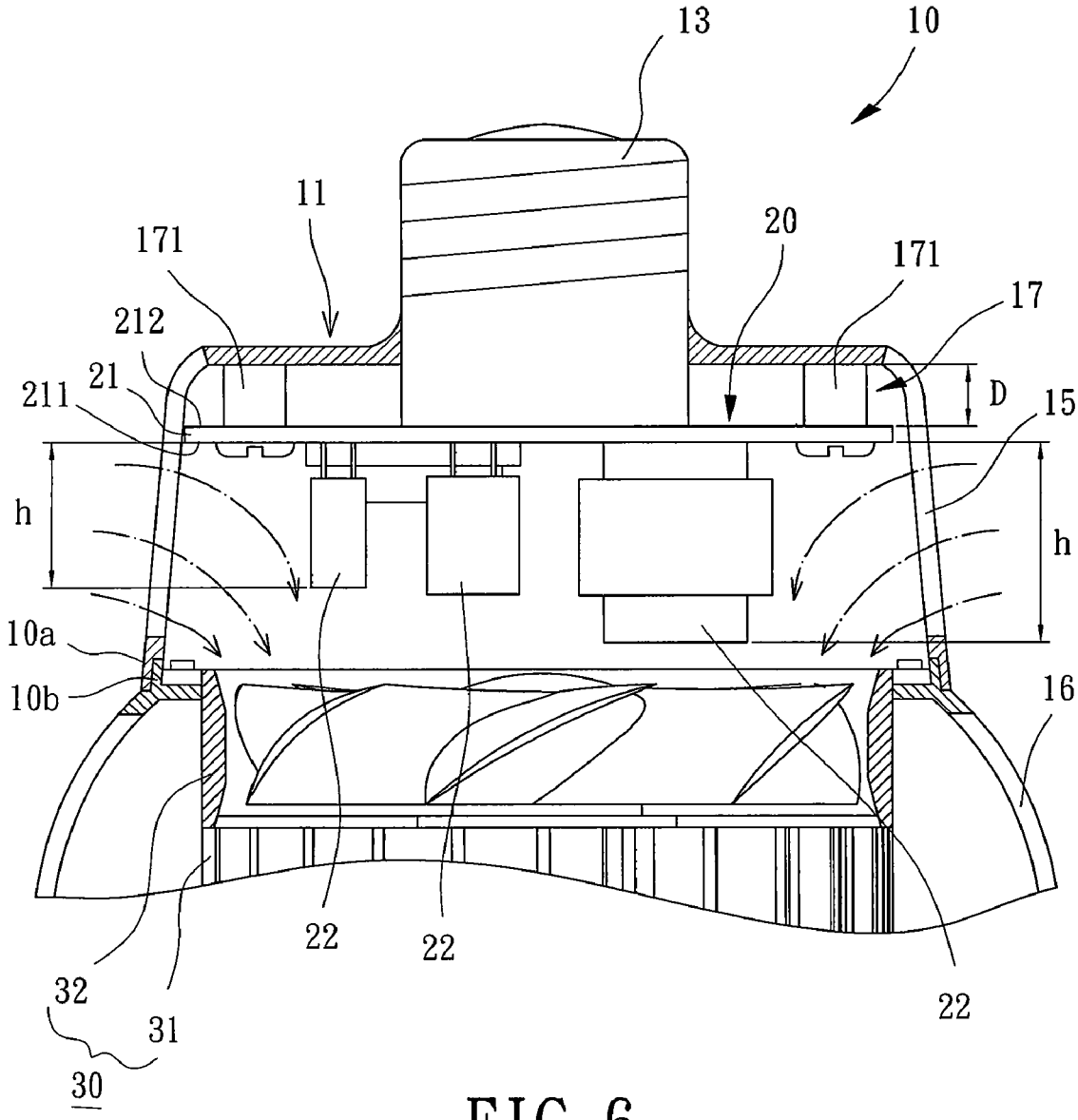
FIG. 6 shows a partial, cross sectional view of the lamp device of FIG. 4, illustrating the flow of the air currents entering the lamp device.

In the preferred form shown in FIG. 5, the electronic elements 22 are mounted on first and second sides 211 and 212 of the substrate 21 of the circuit board (now designated 20'). The electronic element 22 having the largest height h in the axial direction is mounted on the first side 211. Thus, the spacing D between the first end 11 of the housing 10 and the substrate 21 will not be increased by the electronic elements 22 on the second side 212. As a result, the substrate 21 can be in a position closer to the first end 11 of the housing 10, so that the substrate 21 will not cover a large portion of the air inlet portion 15 of the housing 10.

In the preferred forms shown in FIGS. 3-6, the heat dissipating module 30 is mounted in the housing 10 and between the air inlet portion 15 and the air outlet portion 16. The heat dissipating module 30 includes a fin 31 made of heat conductive material and an impeller 32 coupled to a side of the fin 31.

The lighting element 40 can be a light-emitting diode (LED), a bulb, or any element that can emit light beams when supplied with electricity. The lighting element 40 is coupled with the other side of the fin 31 of the heat dissipating module 30 and electrically connects with the circuit board 20.

In use, the electrical connection portion 13 can be coupled to a socket on a wall, a ceiling or a table to supply electricity to the lighting element 40. The light beams emitted from the lighting element 40 pass through the light transmitting portion 14 to the environment. The heat generated by the lighting element 40 is absorbed by the fin 31 and dissipated by the heat dissipating module 30. Specifically, air currents are drawn by the impeller 32 into the housing 10 via the air inlet portion 15 and then exit the housing 10 via the air outlet portion 16. Thus, the heat can be transferred to the environment, providing the desired heat dissipating effect and, thus, prolonging the life of the lighting element 40.

Since the electronic element 20 having the largest height h is mounted on the first side 211 of the substrate 21 and extends towards the second end 12 of the housing 10, the substrate 21 can be in a position closer to the first end 11 of the housing 10, so that the substrate 21 will not cover a large portion of the air inlet portion 15 of the housing 10. Air currents outside the housing 10 can be drawn into the housing 10 more easily, avoiding the flow of the air currents entering the housing 10 from being interfered by the substrate 21 of the circuit board 20. Thus, the airflow can flow smoothly in the housing 10, providing enhanced heat dissipating effect and prolonging the life of the lamp device according to the preferred teachings of the present invention.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A lamp device comprising:

a housing including first and second ends spaced in an axial direction, with the first end including an electrical connection portion, with the second end including a light transmitting portion, with the housing further including an air inlet portion adjacent to the electrical connection portion and an air outlet portion adjacent to the light transmitting portion, with each of the air inlet portion and the air outlet portion extending from an inner periphery through an outer periphery of the housing with both of the air inlet and outlet portions communicate inside and outside of the lamp device;

a circuit board mounted in the housing and electrically connected to the electrical connection portion, with the circuit board including a substrate having first and second sides spaced in the axial direction, with the first side of the substrate facing the second end of the housing, with the second side of the substrate facing the first end of the housing, with the substrate disposed in a position out of a region between the air inlet and outlet portions, with the circuit board further including a plurality of electronic elements mounted on at least one of the first and second sides of the substrate, with each of the plurality of electronic elements having a height in the axial direction, with one of the plurality of electronic elements having the largest height in the axial direction being mounted on the first side and extending toward the second end of the housing;

a heat dissipating module mounted in the housing and between the air inlet portion and the air outlet portion; and a lighting element coupled to the heat dissipating module and electrically connected to the circuit board.

2. The lamp device as claimed in claim 1, with the plurality of electronic elements mounted on the first side of the substrate.

3. The lamp device as claimed in claim 1, with the plurality of electronic elements mounted on the first and second sides of the substrate.

4. The lamp device as claimed in claim 1, with the housing including an inner wall having a positioning portion at the first end of the housing, and with the second side of the substrate coupled to the positioning portion.

5. The lamp device as claimed in claim 4, with the positioning portion including a plurality of pegs formed on the inner wall, with the lamp device further comprising, in combination: a plurality of fasteners extending through the substrate into the plurality of pegs.

* * * * *